United States Patent [19]

Brouthers

[11] 4,200,989

[45] May 6, 1980

[54] GUN SIGHT

[75] Inventor: Paul E. Brouthers, Monson, Mass.

[73] Assignee: D.W.A. Associates, Inc., Monson, Mass.

[21] Appl. No.: 23,259

[22] Filed: Mar. 23, 1979

[51] Int. Cl.[2] ..... F41G 1/16

[52] U.S. Cl. ..... 33/257; 42/1 S

[58] Field of Search ..... 33/233, 252, 257, 258; 42/1 S

[56] References Cited

U.S. PATENT DOCUMENTS

| | | | |
|---|---|---|---|
| 2,494,163 | 1/1950 | Davis | 33/257 |
| 2,963,789 | 12/1960 | Wilhelm | 33/257 |
| 3,495,339 | 2/1970 | Elliason | 33/257 |
| 3,748,744 | 7/1973 | McClenahan | 33/257 |
| 3,942,256 | 3/1976 | Khaidurov et al. | 33/257 |

*Primary Examiner*—William D. Martin, Jr.
*Attorney, Agent, or Firm*—Wolf, Greenfield & Sacks

[57] ABSTRACT

A rear sight for a hand gun adapted to withstand high recoil forces associated with the use of magnum cartridges, in particular at the maximum elevation of the sight for long range shooting. The sight comprises a body pivoted at its front end and including, at its rear end a vertical slot and horizontal dovetail. A flat rear blade having a sighting slot is carried in the horizontal dovetail and is spring loaded at opposite ends. This blade is adjustable for windage and locked in position by means of a roller engaging detents in the head of the windage screw. A vertical slot in the body accommodates a hardened windage plate threaded to receive the windage screw and for entrapping the elevation screw. The elevation screw is of relatively substantial length accommodated in a tapped hole at the rear of the frame, rear of the cylinder and above the firing pin hole. The body of the sight lies in a slot in the top strap of the frame.

12 Claims, 4 Drawing Figures

GUN SIGHT

BACKGROUND AND SUMMARY OF THE INVENTION

The present invention relates in general to a gun sight for a hand gun, and more particularly, to an improved construction of a rear sight for a hand gun with heavy recoil characteristics.

It is typical in prior rear sight constructions to have the elevation screw somewhat limited in its length usually by the thickness of the top strap of the revolver frame over the cylinder opening. A long screw cannot be used as it would protrude into the cylinder opening and would of course obstruct rotation of the cylinder. Furthermore, in prior constructions, the body of the sight is usually relatively short providing for a courser adjustment of elevation of the sight. In accordance with the present invention, by increasing the distance between the pivot for the sight and the elevation screw, the elevation adjustment per click of the elevation screw becomes finer. Also, the elevation screw is accommodated in an internally threaded hole in the revolver frame over the firing pin which is a vertically deeper section of the frame permitting the use of a significantly longer elevation screw especially in a larger frame revolver. In accordance with the present invention, the slot for the body is also substantially deeper than prior constructions thus allowing for greater supported elevation of the rear sight.

Accordingly, it is an object of the present invention to provide an improved rear sight for a hand gun and in particular a hand gun with heavy recoil characteristics. Another object of the present invention is to provide an improved rear sight for a hand gun that is characterized by a finer adjustment of the elevation screw.

A further object of the present invention is to provide an improved rear sight for a hand gun characterized by an increased range of elevation between minimum and maximum elevations of the sight.

Still another object of the present invention is to provide an improved rear sight for a hand gun that is relatively simple in construction, easy to maintain, readily adjusted for both elevation and windage and that is accurate.

To accomplish the foregoing and other objects of this invention there is provided a rear sight for a hand gun which is accommodated in a front to rear slot in the top strap of the hand gun frame over the cylinder opening. This sight comprises a somewhat elongated body disposed in the frame slot having means pivoting the body from the frame at its front end, including a horizontal dovetail channel and also having a centrally disposed vertical slot essentially crossing the dovetail channel. Both elevation and windage screws are provided along with a sighting blade having means slidably interlocking with the dovetail channel of the body and means for receiving the windage screw in a horizontal attitude. The dovetail channel of the body may be of substantially circular shape while the blade may have spaced interlocking cylinders that interlock with the dovetail channel and also have a passage therethrough for receiving the windage screw. The windage screw does not thread with the through passages in the cylinders but does thread with a windage plate that is disposed in the vertical slot in the body. The body is preferably provided with a through passage for receiving the elevation screw in a vertical attitude with the elevation screw being accomplished by a tapped hole in the gun frame rearwardly of the cylinder opening. In this way the elevation screw can be made of substantial length especially in comparison with prior art arrangements. Also, the pivot for the body is at a location spaced forwardly of the elevation screw and over the cylinder opening there may also be provided biasing means including at least one spring for urging the body away from the frame. This spring or pair of springs is disposed between the body pivot and the elevation screw. The elevation screw locks the body downwardly against the pressure of the springs. The windage screw preferably has a threaded nut and means for fixing the nut at one particular position along the windage screw so that when the windage screw is rotated, the nut rotates therewith. There is also preferably provided an elongated windage spring extending longitudinally of the windage screw and supporting at one end, roller means adapted to register with detents in the windage screw head and at the other end a loop disposed about the windage screw adjacent to its head.

Among the features of the present invention is a greater supported elevation range of the sight due primarily to the location of the elevation screw rearwardly of the cylinder opening permitting use of a relatively long elevation screw. Another feature of the present invention is the envelopment of the elevation screw by the windage plate which restricts vertical movement of the sight particularly under heavy recoil conditions. Another feature is the spring loading provided by the windage spring to provide spring loading of the sight blade assuring positive engagement with the dovetail channel. Still another feature is the roller engagement with the windage screw detents. This reduces wear and increases sight life. There is also a finer elevation adjustment thus reducing bullet impact shift per click of the adjustment. This is accomplished to a large extent by providing a relatively substantial distance between the pivot for the body and the elevation screw which again is possible by having the elevation screw at a rearward section of the gun frame rearwardly of the cylinder opening.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
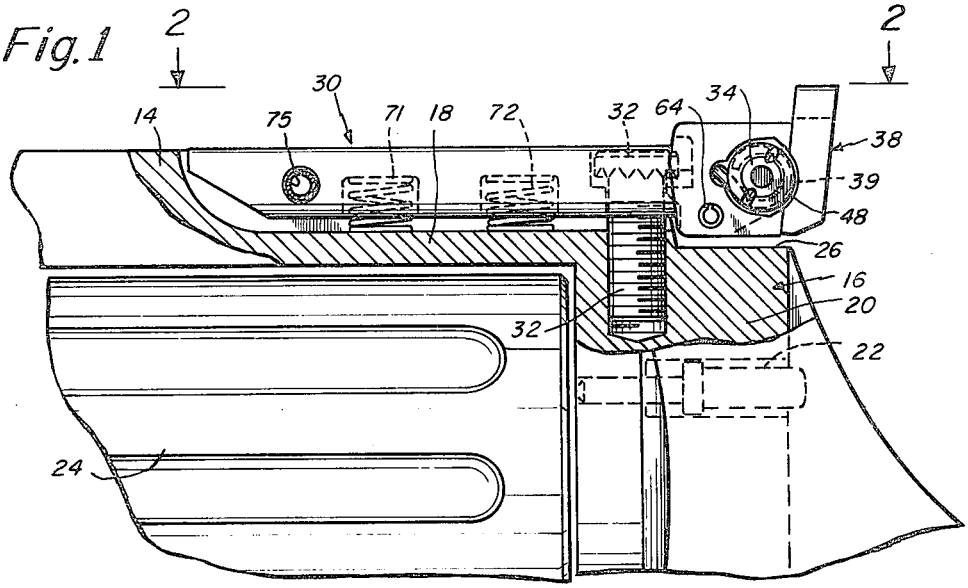
FIG. 1 is a fragmentary view of a hand gun provided with the rear sight of the present invention.

Referring now to the drawings, there is shown a preferred embodiment of a rear gun sight constructed in accordance with the principles of the invention. This gun sight is preferably adapted for use with a hand gun and is accommodated in a longitudinal slot 12 on the top strap 14 of the frame 16 of the hand gun. The drawing depicts only a fragmentary portion of the hand gun sufficient to describe the principles of the invention. In this connection the frame 16 includes a thin-walled section 18 and a rear section 20 disposed over the firing pin 22. There is, of course, a hammer, (not shown) that is associated with the hand gun. The thin-walled section 18 overlies the opening for the cylinder 24. It is also noted that the frame 16 of the hand gun is provided with an indented ledge 26 adjacent to the slot 12 and rearwardly thereof. This arrangement optimizes the range of the elevation screw and thus the elevation adjustment of the weapon.

Figure 3:
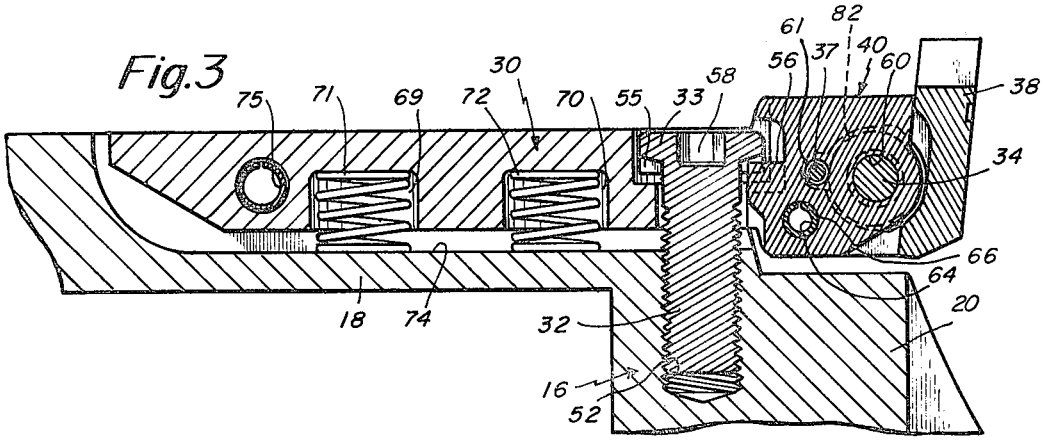
FIG. 3 is a cross-sectional view taken along line 3—3 of FIG. 2.
Figure 4:
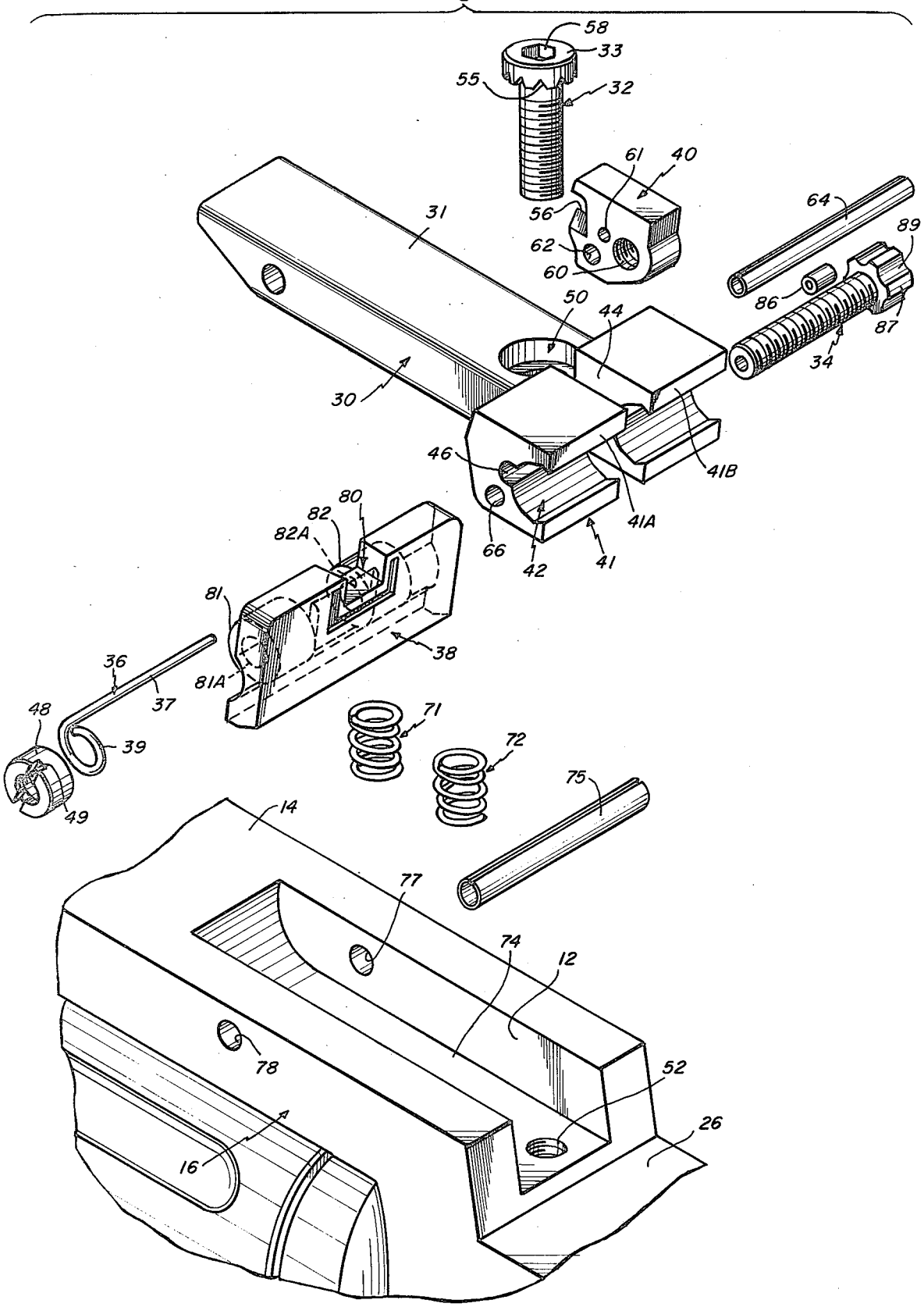
FIG. 4 is an exploded perspective view showing all of the components comprising the rear sight construction and a portion of the top section of the frame of the hand gun which accommodates the rear sight.

The sight comprises a body 30, elevation screw 32, windage screw 34, windage spring 36, sighting leaf or blade 38, and windage plate 40. The body 30 has an elongated forward end 31 and a wider rearward end 41 having a dovetail channel 42. The end 41 is separated into sections 41A and 41B separated by the vertical slot 44 which receives the windage plate 40. The dovetail channel 42 is of substantially circular shape and has at one side an elongated groove 46 for accommodating the straight section 37 of the windage spring 36. The windage spring 36 also includes a looped end 39 which fits about the windage screw 34 abutting against the nut 48 which threads onto the end of the windage screw 34. The forward end 31 of the body 30 is also provided with a hole 50 through which the elevation screw 32 extends. The hole 50 is actually a stepped hole as indicated in FIG. 3 and accommodates the head 33 of the elevation screw 32. The elevation screw 32 as indicated in FIGS. 1 and 3 is received in a tapped hole 52 in the section 20 of the frame of the hand gun.

The elevation screw 32 at the bottom edge of its head 33 has a serrated-type edge forming detents 55 which interlock with the edge 56 of the windage plate 40. It is the interaction between the elevation screw 32 and the edge 56 of the windage plate 40 that provides the fine clicking adjustment with regards to elevation of the sight. The elevation screw 32 is also provided with a hexagonal opening 58 in the head 33 for accommodating an "Allen" wrench for adjustment of the screw 32 and the elevation of the sight.

The windage plate 40 includes a threaded hole 60 for receiving the windage screw 34. There is also provided a relatively small hole 61 through which the elongated section 37 of the windage spring 36 extends. There is also a slightly larger hole 62 for accommodating the roll pin 64. The roll pin 64 essentially interconnects the windage plate 40 with the body by means of another passage 66 extending through the rear section 41 of the body 30. The roll pin 64 is fitted with the windage plate 40 at the body with a relatively tight fit. The fit causes a closing and compression of the pin 64 by virtue of the elongated slot therein which will close as the pin is forced into the passages through the body and plate.

The elongated section 31 of the body is provided with wells 69 and 70 for respectively accommodating coiled springs 71 and 72. These springs at one end bottom into the well and at the other end rest upon the bottom surface 74 of the slot 12 in the upper strap of the frame of the hand gun. These springs 71 and 72 urge the body away from the frame. The body is pivoted by means of the pivot pin 75 which extends through the section 31 at its forward end and also through accommodating side holes 77 and 78 in the frame of the hand gun. The springs 71 and 72 urge the body into firm contact with the elevation screw 32. Actually, the edge 56 of the windage plate is in contact with the elevation screw 32.

Figure 2:
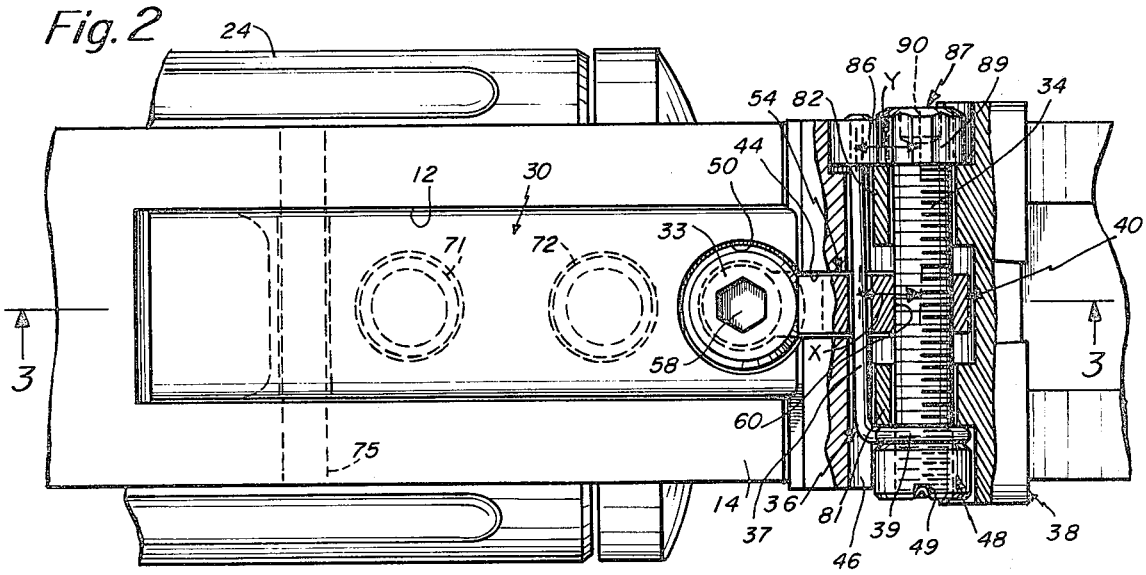
FIG. 2 is a top elevation view of the rear sight of FIG. 1 partially cut away in the area of the sight blade and windage screw.

The sighting blade 38 is provided with a sighting slot 80 at the top thereof and interlocking cylinders 81 and 82 integral with the blade 38 and each having through passages 81A and 82A, respectively, through which the windage screw 34 extends. FIG. 2 shows the interlocking cylinders or journals 81 and 82 with the windage screw 34 extending therethrough but not in threaded contact therewith. The windage screw 34 is only threaded with the internally threaded hole 60 in the windage plate 40. The cylinders 81 and 82 fit snugly in the dovetail channel 42 in the end sections 41A and 41B.

The nut 48 is threaded onto the end of the windage screw 34 with the looped end 39 of the spring 36 about the windage screw as clearly depicted in FIG. 2. The elongated end 37 of the spring 36 extends through the groove 46 and the passage 61 in the windage plate 40. The nut 48 is threaded so that it is snug with the nut, spring loop, and the head of the screw 34 contacting against the cylinders 81 and 82. Once in this snugged position the screw is staked to the nut in the slot 40 of the nut. This staking occurs at two points on opposite sides of the nut. The purpose of the staking is to secure the nut to the screw so that they are non-rotatable relative to each other. In this way when the windage screw 34 is rotated, then, with the windage plate 40 being stationary in a horizontal sense, any movement of the screw 34 will cause the sighting blade 38 to move in a side-to-side direction to adjust windage.

The adjustment of the windage screw 34 is made in conjunction with the spring 36, which supports at the outer end of the straight portion 37, the roller 86. The roller 86 may be secured to the very end of section 37 using a known technique. The windage screw 34 is provided with a head 87 having arcuate detents 89 which can accommodate the roller 86. Each rotation of the screw 34 causes the detent surfaces to interlock on a clicking basis with the roller 86. For rotation of the screw 34 there is provided an hexagonal recess 90 for accommodating an "Allen" wrench or the like.

The spring 36 is constructed with its section 37 relatively straight but when the section 37 is engaged with the windage plate 40 it is caused to be bowed slightly. This is caused by providing the small hole 61 slightly closer to the center line of the windage screw than the groove 46. In this way the roller end of the spring 36 is urged into intimate contact with the head of the windage screw. This biasing action also causes a slight deflection of the loop 39 of the windage spring. In this way as the nut 48 is tightened, it is forced against the bias provided at the loop 39 to essentially spring load the windage screw in relationship to the sight blade and thus provide positive engagement of the sight blade with the body. The spring loading provided by the proper selection of the position of the hole 61. This hole is provided so that the spring 36 at its straight section is bowed slightly inwardly at its mid-point toward the windage screw. FIG. 2 shows the arrangement most clearly wherein the dimension X is essentially the distance from the center line of the windage screw to the center line of hole 61 is a smaller distance than the distance Y which is also taken from the center line of the windage screw to the center line of the roller. This distance may be slight even as small as on the order of 10–15 thousandths of an inch but is sufficient to provide the spring loading action.

What is claimed is:

1. A rear sight for a hand gun accommodated in a slot in the top strap of the gun frame over the cylinder opening comprising:

a somewhat elongated body disposed in the frame slot having means pivoting the body from the frame at its front end, a horizontal dovetail channel and a centrally disposed vertical slot, an elevation screw, a windage screw, a sighting blade having means slideably interlocking with the dovetail channel of the body and means for receiving the windage screw in a horizontal attitude, a windage plate disposed in the vertical slot in the body and having means for threadedly receiving the windage screw, said body having means for receiving the elevation screw in a vertical attitude, said elevation screw accommodated in a tapped hole in the gun frame rearwardly of the cylinder opening, the pivot for the body being at a location spaced forwardly of the elevation screw and over the cylinder opening.

2. A rear sight as set forth in claim 1 including biasing means for the body disposed between the body and frame for urging the body upwardly at its rear.

3. A rear sight as set forth in claim 2 including at least one spring disposed between the body pivot and the elevation screw.

4. A rear sight as set forth in claim 1 including a nut threaded with the end of the windage screw and means fixing the nut at one position along the windage screw.

5. A rear sight as set forth in claim 4 including an elongated windage spring extending longitudinally of the windage screw and supporting roller means adapted to register with detents in the windage screw head.

6. A rear sight as set forth in claim 5 wherein said windage spring has a looped end about the windage screw at an end thereof opposite the screw head.

7. A rear sight as set forth in claim 1 wherein said windage plate has means defining an edge for cooperating with detents in the elevation screw head.

8. A rear sight as set forth in claim 7 including a roll pin interconnecting the body and windage plate extending parallel to the windage screw and accommodating the windage spring.

9. A rear sight as set forth in claim 1 wherein the dovetail channel is circular and the blade has spaced interlocking cylinders interlocking with the dovetail channel and also having a passage through both cylinders for receiving the windage screw.

10. A rear sight as set forth in claim 9 wherein the windage screw is threaded only with the windage plate and absent threading with the sighting blade.

11. A rear sight as set forth in claim 5 wherein the windage plate has a hole for accommodating the windage spring positioned to cause spring loading of the roller means and spring loading of the windage screw relative to the blade.

12. A rear sight as set forth in claim 11 wherein said windage spring has a straight section that is slightly bowed at its mid-point in the direction of the windage screw.

* * * * *